US007637042B2

(12) United States Patent
Chen

(10) Patent No.: US 7,637,042 B2
(45) Date of Patent: Dec. 29, 2009

(54) AUTOMATIC INDUCTION DEVICE FOR TURNING PAGES

(75) Inventor: Ying-I Chen, Taipei County (TW)

(73) Assignee: Taiwan Stamp Enterprise Co., Ltd., Taipei County (TW)

( * ) Notice: Subject to any disclaimer, the term of this patent is extended or adjusted under 35 U.S.C. 154(b) by 131 days.

(21) Appl. No.: 11/755,370

(22) Filed: May 30, 2007

(65) Prior Publication Data

US 2008/0295369 A1 Dec. 4, 2008

(51) Int. Cl.
*B41J 11/36* (2006.01)

(52) U.S. Cl. ..... 40/343; 40/455; 40/463; 40/906; 434/317; 434/308

(58) Field of Classification Search ..... 40/906; 434/317, 308; 281/42; 369/30.02; 340/686.1, 340/635–664; 345/901
See application file for complete search history.

(56) References Cited

U.S. PATENT DOCUMENTS 2,528,086 A * 10/1950 Schenck ..... 200/265
5,191,329 A * 3/1993 Samreus ..... 341/20
5,374,195 A * 12/1994 McClanahan ..... 434/317
6,041,215 A * 3/2000 Maddrell et al. ..... 434/317
6,265,986 B1 * 7/2001 Oka et al. ..... 340/815.52
6,421,524 B1 * 7/2002 Padgett ..... 434/317
6,491,220 B1 * 12/2002 May ..... 235/435
6,513,836 B2 * 2/2003 Li ..... 281/22
7,290,700 B2 * 11/2007 Song ..... 235/375
2003/0046847 A1 * 3/2003 Yoshida ..... 40/717
2003/0108855 A1 * 6/2003 Kuen Chan ..... 434/317
2005/0202387 A1 * 9/2005 Henderson et al. ..... 434/317
2007/0046483 A1 * 3/2007 White et al. ..... 340/686.1

* cited by examiner

*Primary Examiner*—Paul N. Dickson
*Assistant Examiner*—Christopher E Veraa
(74) *Attorney, Agent, or Firm*—Rosenberg, Klein & Lee

(57) ABSTRACT

An automatic induction device for turning pages includes a plurality of inner pages, a plurality of conductive rubber pieces, a flexible printed circuit board, and an electronic unit. The inner pages connect with each other on one side and each has a groove on the connected side. The conductive rubber pieces are inserted in the grooves respectively and one end of each conductive rubber piece extends out of the corresponding groove. The flexible printed circuit board has a plurality of connecting finger conductive portions and a connecting end, the connecting finger conductive portions are inserted in the grooves and contact with the conductive rubber pieces, respectively. The electronic unit electrically connects with the connecting end of the flexible printed circuit board. Based on the above assemblies, the automatic induction device for turning pages, electronic audio books and photo albums has more reliable performance, a simple structure and a low cost.

6 Claims, 6 Drawing Sheets

AUTOMATIC INDUCTION DEVICE FOR TURNING PAGES

BACKGROUND OF THE INVENTION

1. Field of the Invention

The present invention relates to an automatic induction device for turning pages, and more especially to an improved structure of an induction switch for electronic audio books, photo albums, etc.

2. Description of the Prior Art

Conventional books only allow users to read. That is, the contents of books can only be read by the users and cannot be converted into audio signals to be played. With the digitization and rapid development of electronic industries, electronic products have become small in size, but have increasingly powerful functions. In recent years, electronic technology has become widely used in education, and electronic audio books are one of the most major forms of such applications. Through audio ICs and speakers disposed in electronic audio books, users can listen to the contents of books.

For example, Taiwan Patent No. 369194, published on Sep. 1, 1999, discloses an induction device for sensing page numbers of an electronic book. The induction device includes a plurality of marks and a detection device. Each mark is disposed on an edge of each page of the electronic audio book and has a different shape corresponding to a different page number for each page. The detection device is placed on the edge of the electronic audio book depending on the positions of the marks. The detection device is turned on by a user's touch so as to detect a page number, represented by a mark. Then a start signal is sent to start an audio player to play audio files corresponding to the page. The plurality of marks is a plurality of inverted U-shaped conductive pieces with different spans corresponding to the different page numbers of the pages.

The above conductive pieces are metallic elastic pieces. Because the conductive pieces need to frequently contact and press the reading device of the detection device, the conductive pieces easily fatigue, deform or displace the elastic, which results in the conductive pieces being unable to trigger or being triggered by mistake. Consequently, the electronic audio book cannot output the correct audio. Furthermore, an electronic audio book uses the plurality of marks (conductive pieces) and the detection device to form induction switches. Because the detection device further includes a reading device, a compression spring and so on, this makes the structure more complicated and increases costs.

Hence, the inventors of the present invention believe that the shortcomings described above are able to be improved and finally suggest the present invention which is of a reasonable design and is an effective improvement based on deep research and thought.

SUMMARY OF THE INVENTION

An object of the present invention is to provide an automatic induction device for turning pages which ensures triggering takes place more reliably. The present invention has a simple structure and a low cost.

To achieve the above-mentioned object, an automatic induction device for turning pages in accordance with the present invention is disclosed. The automatic induction device for turning pages includes a plurality of inner pages, connecting with each other on one side and each having a groove on the connected side; a plurality of conductive rubber pieces which are inserted in the grooves respectively, one end of each conductive rubber piece extending out of the corresponding groove; a flexible printed circuit board which has a plurality of connecting finger conductive portions and a connecting end, and the connecting finger conductive portions are inserted in the grooves and contact the conductive rubber pieces, respectively; and an electronic unit electrically connecting with the connecting end of the flexible printed circuit board.

The efficacy of the present invention is as follows: the present invention uses conductive rubber pieces as induction switches to avoid elastic fatigue, deformation and displacement and ensures that triggering takes place more reliably. Furthermore, the present invention connects the conductive rubber pieces with an electronic unit via a flexible printed circuit board, so that the structure is simplified and the cost reduced.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 1:
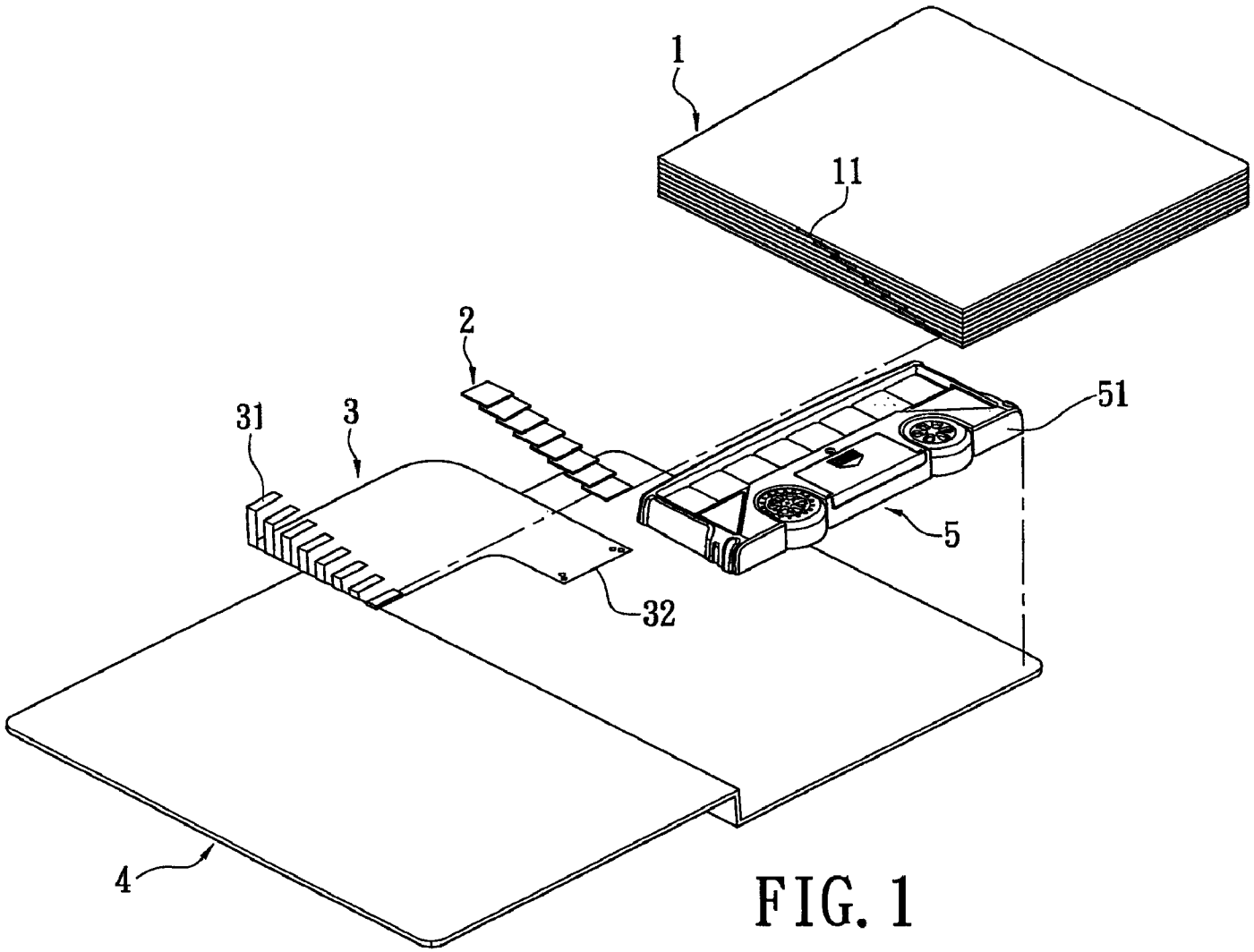
FIG. 1 is an exploded perspective view of an automatic induction device for turning pages in accordance with the present invention.

Please refer to FIGS. 1-6. The present invention provides an automatic induction device for turning pages of books, photo albums, and so on. The automatic induction device for turning pages includes a plurality of inner pages 1, a plurality of conductive rubber pieces 2, a flexible printed circuit board 3, a cover 4 and an electronic unit 5. The inner pages 1 are made of paper or other materials. The inner pages 1 connect with each other on one side so that any inner page 1 can be turned to a predetermined page according to the needs of the user. Each inner page 1 has a groove 11 formed on a connected side thereof. The groove 11 of one inner page 1 corresponds to an adjacent inner page 1 in part (about one-third of the width of the grooves 11) in a vertical direction. The grooves 11 have a predetermined depth.

Figure 2:
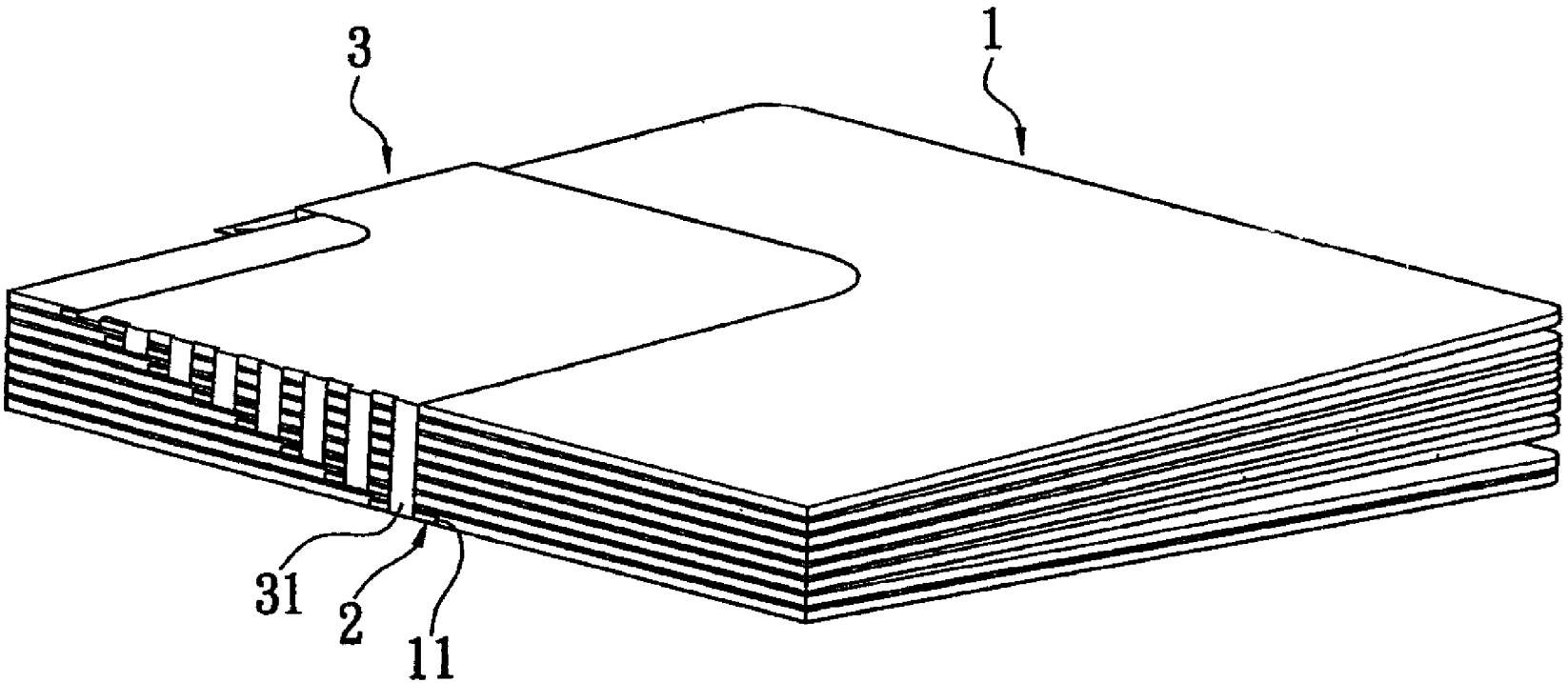
FIG. 2 is a partial perspective view of the automatic induction device for turning pages in accordance with the present invention.
Figure 3:
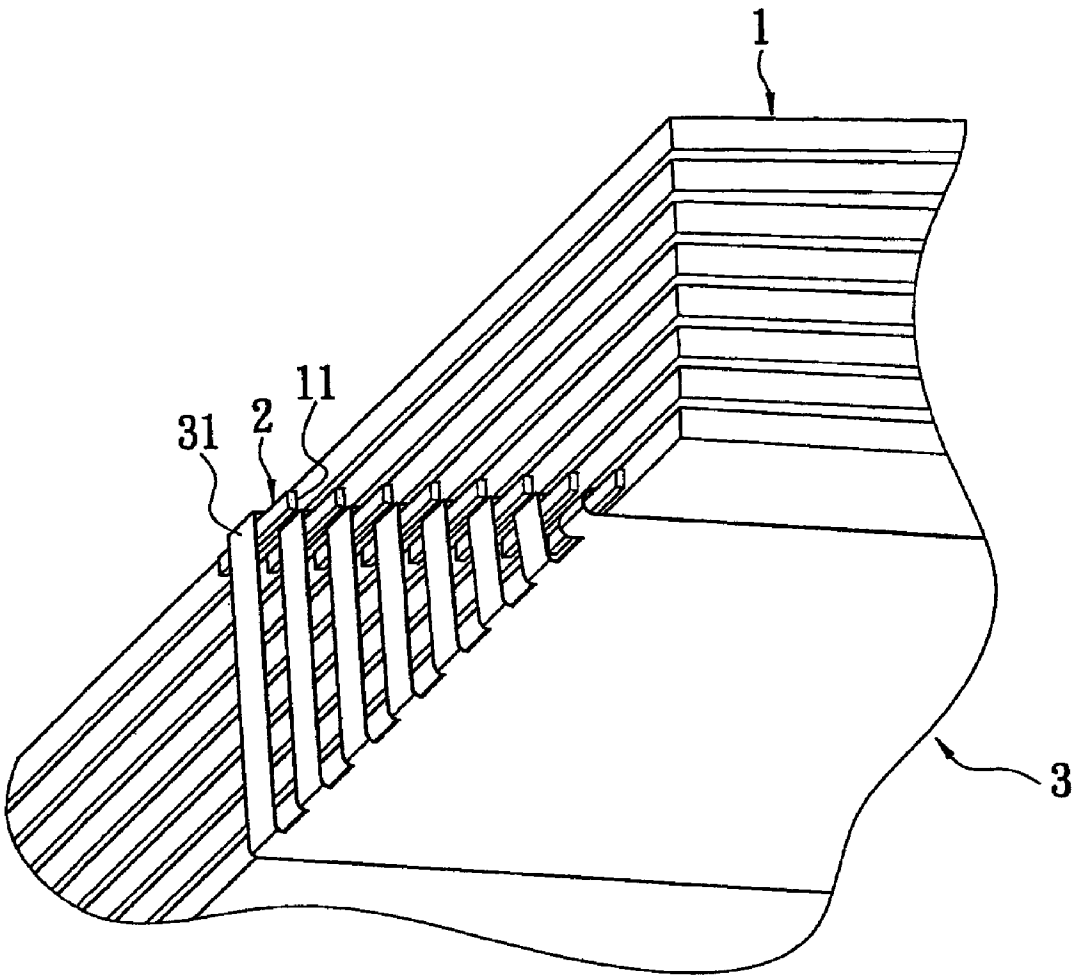
FIG. 3 is another partial perspective view of the automatic induction device for turning pages in accordance with the present invention.
Figure 4:
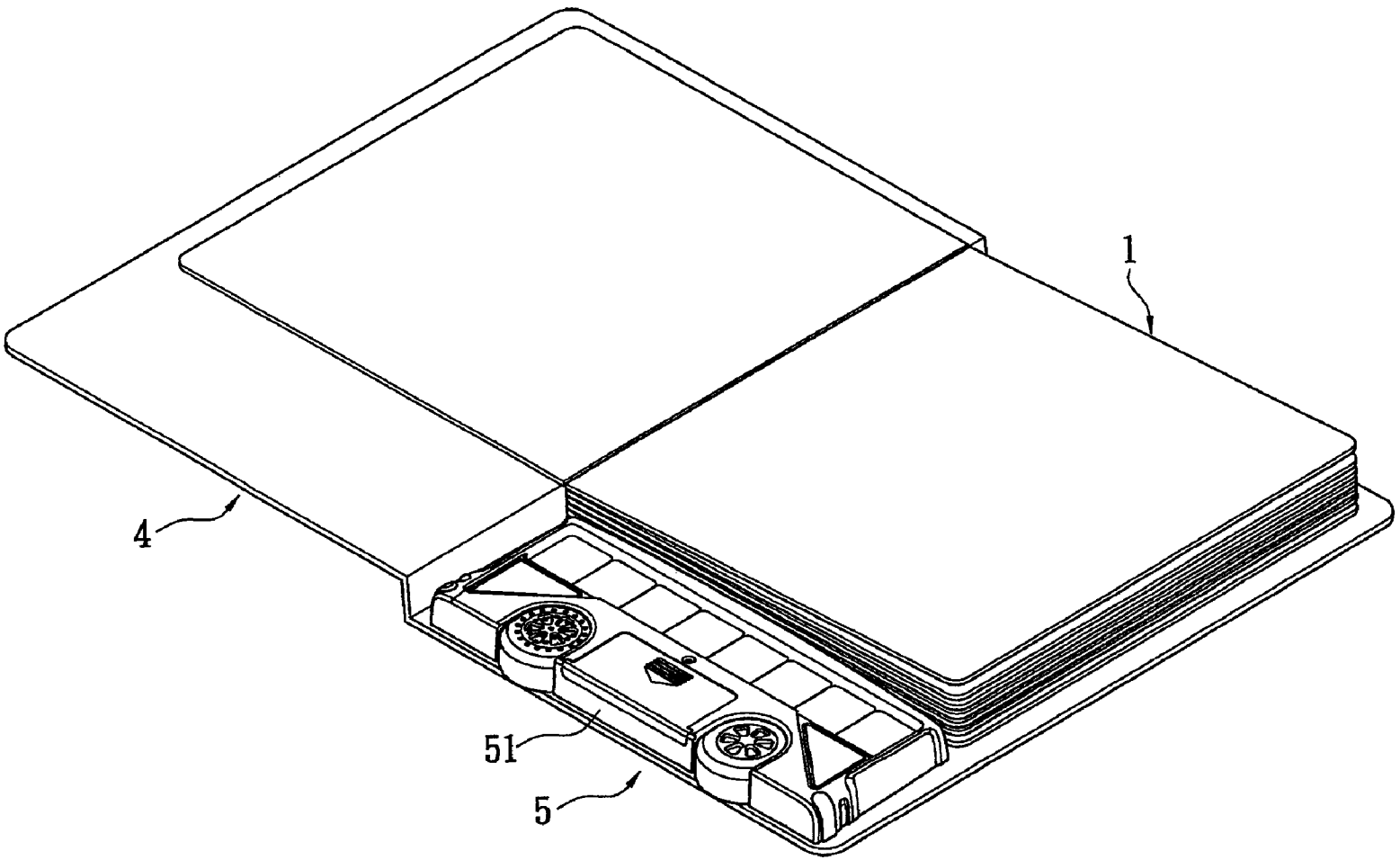
FIG. 4 is an assembled perspective view of the automatic induction device for turning pages in accordance with the present invention.
Figure 5:
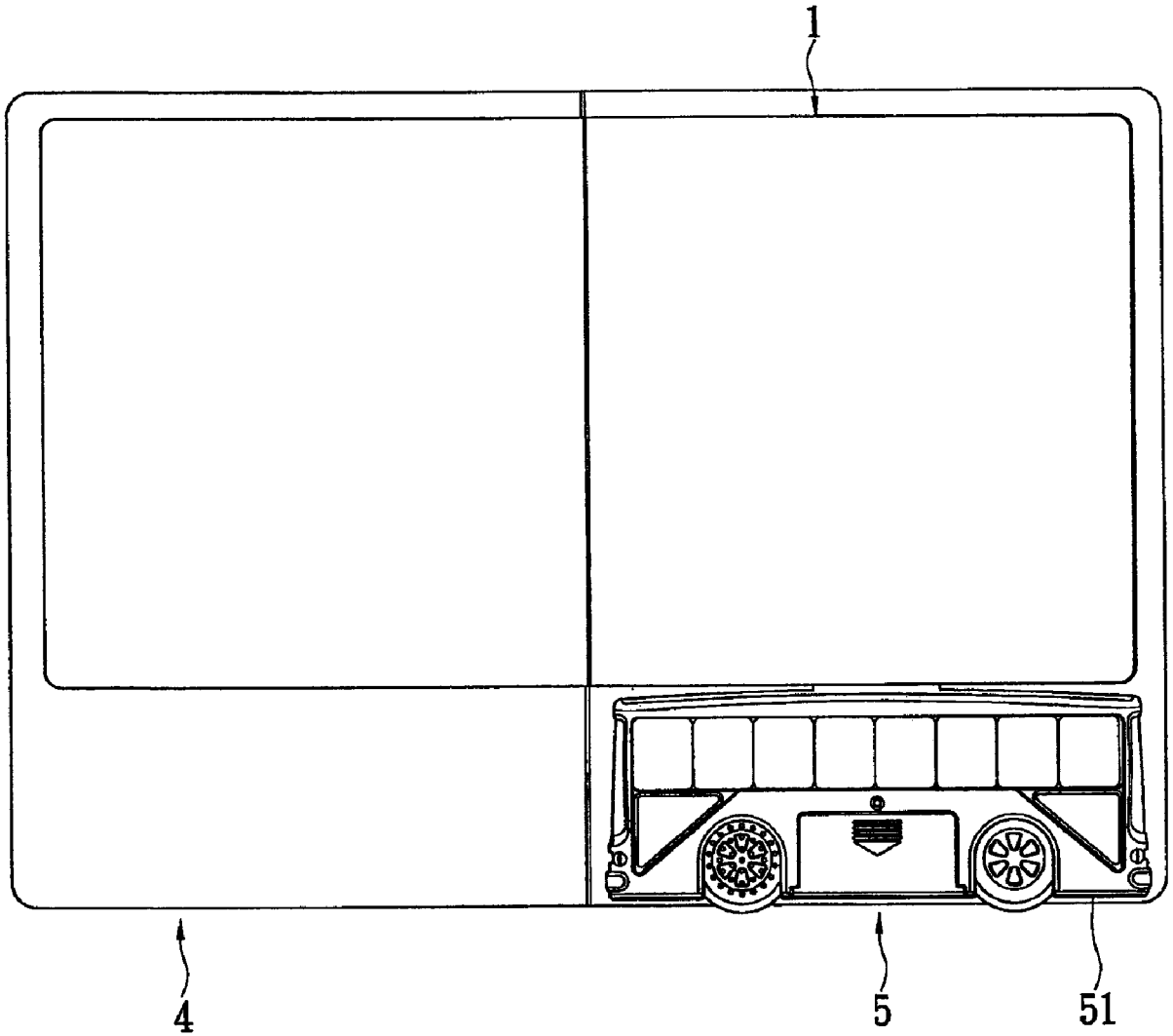
FIG. 5 is a top view of the automatic induction device for turning pages in accordance with the present invention.
Figure 6:
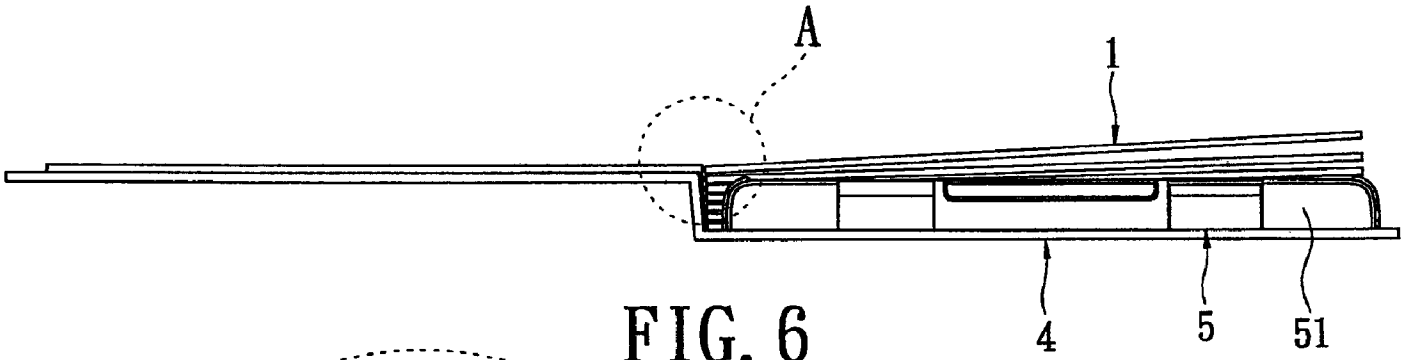
FIG. 6 is a front view of the automatic induction device for turning pages in accordance with the present invention.
Figure 6A:
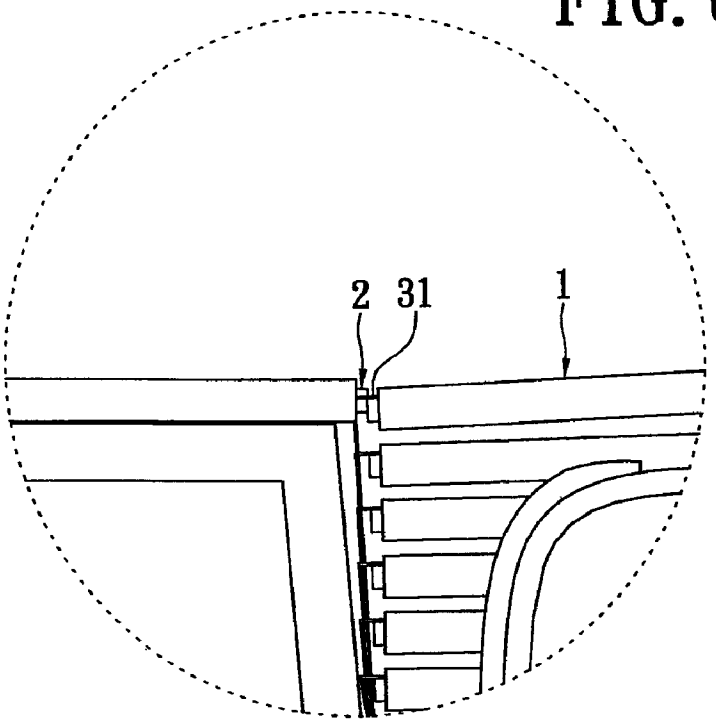
FIG. 6A is a detailed view of part A of FIG. 6.

The conductive rubber pieces 2 are made of conductive rubber and are sheet-shaped. The width of the conductive rubber pieces 2 is equal to that of the grooves 11. The length of the conductive rubber pieces 2 is greater than the depth of the grooves 11. The conductive rubber pieces 2 are respectively inserted in the grooves 11 (as shown in FIG. 2 and FIG. 3). Since the length of the conductive rubber pieces 2 is about 0.5~0.8 mm greater than the depth of the grooves 11, one end of each conductive rubber piece 2 extends out of the corresponding groove 11 for about 0.5~0.8 mm to be a trigger conductor for turning pages, so that the conductive rubber pieces 2 of two inner pages 1 can contact each other. The trigger angle for turning pages can be controlled by the length of the exposed portion of each conductive rubber piece 2, for example, the longer the exposed portion is, the smaller the trigger angle is.

The flexible printed circuit board 3 electrically connects the conductive rubber pieces 2 and the electronic unit 5. Two ends of the flexible printed circuit board 3 respectively form a plurality of connecting finger conductive portions 31 that correspond to the conductive rubber pieces 2 and a connecting end 32. The connecting finger conductive portions 31 are formed by extending and bending one end of the flexible printed circuit board 3, so that they correspond to the grooves 11. The flexible printed circuit board 3 and the inner pages 1 are connected by double-faced adhesive tape. The plurality of connecting finger conductive portions 31 of the flexible printed circuit board 3 are inserted in the grooves 11 so as to contact the conductive rubber pieces 2, respectively (as shown in FIG. 2 and FIG. 3). The inserted position is the middle portion of the conductive rubber pieces 2 that ensures the electrical connection between the connecting finger conductive portions 31 and the conductive rubber pieces 2.

The cover 4 is made of paper or other materials. The inner pages 1 are connected with the flexible printed circuit board 3 by double-faced adhesive tape firstly, and then connected with an inner surface of the cover 4 by double-faced adhesive tape. Thereby the cover 4 covers the inner pages 1.

The electronic unit 5 has a shell 51 made of plastic material. Electronic devices such as an electronic circuit, batteries and so on are mounted inside the shell 51. The connecting end 32 of the flexible printed circuit board 3 extends into the shell 51 of the electronic unit 5 and electrically connects with the electronic circuit inside the electronic unit 5. Induction switches formed by the conductive rubber pieces 2 engage with the flexible printed circuit board 3 to control and activate the electronic unit 5 to play sound files corresponding to the inner pages 1. Since the structure of the electronic unit 5 is known by those skilled in the art, the detailed description about the electronic unit 5 will be omitted. The electronic unit 5 is attached and fixed onto the cover 4 by gluing. Based on the above assemblies, the automatic induction device for turning pages of the present invention is formed.

As shown in FIGS. 4-6 and FIG. 6A, to turn to any page of the inner page 1, the conductive rubber piece 2 in the inner page 1 can turn along with the inner page 1. When the inner page 1 is turned to an angle between 160 degrees and 180 degrees, the conductive rubber piece 2 in the inner page 1 will contact with a conductive rubber piece 2 in an adjacent inner page 1 to trigger a corresponding switch of the circuit through the flexible printed circuit board 3. Thereby a trigger function of the switch is performed which makes the electronic unit 5 automatically take corresponding actions such as outputting audio. Besides outputting audio, the electronic unit 5 also can emit light and image. That is, the electronic unit 5 produces audio-visual images.

The conductive rubber pieces 2 of the present invention are evenly disposed at intervals of one-third width of each conductive rubber piece 2. This ensures that only the conductive rubber pieces 2 on two adjacent inner pages can contact each other on the structure and avoids false actions caused by the first inner page contacting the third inner page. In other words, only when the first and the second inner pages, or the second and the third inner pages, or the third and the fourth inner pages, and so on, are turned to, it is possible to trigger the circuit, and two nonadjacent inner pages never contact each other. It ensures that in any state of normally turning pages, only two adjacent inner pages can possibly contact each other to trigger the circuit and false triggering caused by two nonadjacent inner pages is avoided. The present invention has reliable performance, low cost, and is easy to use.

Additionally, the present invention uses the conductive rubber pieces 2 as the induction switches to avoid elastic fatigue, deformation and displacement of metal elastic pieces, thereby ensuring triggering takes place more reliably. Therefore the performance of the structure according to the present invention is more reliable. The present invention connects the conductive rubber pieces 2 with the electronic unit 5 via the flexible printed circuit board 3, so that the structure is simplified and costs are reduced.

What is disclosed above is only the preferred embodiment of the present invention and it is therefore not intended that the present invention be limited to the particular embodiments disclosed. It will be understood by those skilled in the art that various equivalent changes may be made depending on the specification and the drawings of present invention without departing from the scope of the present invention.

What is claimed is:

1. An automatic induction device for turning pages, comprising:

a plurality of inner pages, contiguous each to the other on one side and each having a groove formed within each of said inner pages, each of said grooves formed on adjacent pages wherein each of said grooves partially overlap a next succeeding groove;

a plurality of conductive rubber pieces, inserted in the grooves respectively, one end of each conductive rubber piece extending out of the corresponding groove;

a flexible printed circuit board, having a plurality of connecting finger conductive portions and a connecting end, wherein the connecting finger conductive portions are respectively inserted in the grooves and contacting the conductive rubber pieces; and an electronic unit, electrically connecting with the connecting end of the flexible printed circuit board;

wherein each two of the adjacent conductive rubber pieces in the grooves partially contact each other after turning the inner pages, sound files can be played correspondently to the inner pages.

2. The automatic induction device for turning pages as claimed in claim 1, wherein the last page of the inner pages adheres to the flexible printed circuit board.

3. The automatic induction device for turning pages as claimed in claim 1, wherein the length of the conductive rubber pieces is greater than the depth of the grooves.

4. The automatic induction device for turning pages as claimed in claim 1, wherein the electronic unit has a shell, an electronic circuit is disposed inside the shell, the connecting end of the flexible printed circuit board extends into the shell of the electronic unit and electrically connects with the electronic circuit.

5. The automatic induction device for turning pages as claimed in claim 1, further comprising a cover, the inner pages are connected with an inner surface of the cover.

6. The automatic induction device for turning pages as claimed in claim 1, being an automatic induction for turning pages for books or photo albums.

* * * * *